US008689499B2

(12) United States Patent
Mihashi et al.

(10) Patent No.: US 8,689,499 B2
(45) Date of Patent: Apr. 8, 2014

(54) DOUBLE GLAZED WINDOW GLASS STRUCTURE

(71) Applicant: Yachiyo Industry Co., Ltd., Sayama (JP)

(72) Inventors: Ayumi Mihashi, Sakura (JP); Yoshiyasu Ito, Sakura (JP)

(73) Assignee: Yachiyo Industry Co., Ltd., Sayama-Shi, Saitama (JP)

( * ) Notice: Subject to any disclaimer, the term of this patent is extended or adjusted under 35 U.S.C. 154(b) by 0 days.

(21) Appl. No.: 13/953,791

(22) Filed: Jul. 30, 2013

(65) Prior Publication Data

US 2014/0069037 A1 Mar. 13, 2014

(51) Int. Cl.
*E06B 3/66* (2006.01)

(52) U.S. Cl.
USPC ..... 52/172; 52/786.13

(58) Field of Classification Search
USPC ..... 52/172, 786.13, 204.593, 656.6, 204.6
See application file for complete search history.

(56) References Cited

U.S. PATENT DOCUMENTS 2,383,691 A * 8/1945 Smith ..... 52/204.593
3,935,683 A * 2/1976 Derner et al. ..... 52/172
6,055,783 A * 5/2000 Guhl et al. ..... 52/204.62
6,662,523 B2 * 12/2003 Hornung et al. ..... 52/786.13
6,886,297 B1 * 5/2005 Crandell ..... 52/172
7,537,813 B2 * 5/2009 Mottelet et al. ..... 428/34
7,997,037 B2 * 8/2011 Crandell et al. ..... 52/204.593
8,209,922 B2 * 7/2012 Petersen ..... 52/204.62
2005/0028458 A1 * 2/2005 Rosskamp et al. ..... 52/172
2007/0261795 A1 * 11/2007 Rosskamp et al. ..... 156/556
2010/0287856 A1 * 11/2010 Yun ..... 52/209
2011/0036027 A1 * 2/2011 Back et al. ..... 52/172

FOREIGN PATENT DOCUMENTS

GB 2144167 A * 2/1985 ..... E06B 3/66
JP H4-14682 U 2/1992

* cited by examiner

*Primary Examiner* — Christine T Cajilig
(74) *Attorney, Agent, or Firm* — Dority & Manning, PA

(57) ABSTRACT

A double glazed window glass structure includes a frame defining an outer perimeter of the window glass structure, and first and second sheet glasses mounted on respective sides of the frame to define a heat insulation space therebetween. The frame includes an outer frame portion and an inner frame portion extending from an inner surface of the outer frame portion toward an inside of the frame. The inner frame portion has first and second sheet glass receiving surfaces bonded to the first and second sheet glasses, respectively. The inner frame portion is provided with a groove having an opening that opens in the second sheet glass receiving surface, the groove containing a drying agent therein, and a communication passage allowing only a fluid to flow between the groove and the heat insulation space. The opening of the groove is closed by the second sheet glass.

6 Claims, 4 Drawing Sheets

DOUBLE GLAZED WINDOW GLASS STRUCTURE

CROSS-REFERENCE TO RELATED APPLICATIONS

This application claims the priority of Japanese Patent Application No. 2012-200148, filed in the Japanese Patent Office on Sep. 12, 2012, the disclosure of which is hereby incorporated by reference herein in its entirety for all purposes.

TECHNICAL FIELD

The present invention relates to a double glazed window glass structure, and particularly to a double glazed window glass structure for use as a shield glass (window glass) in a window opening, skylight (roof window) or the like of a building.

BACKGROUND OF THE INVENTION

An example of a double glazed window glass structure for use as a window glass of a building is disclosed in JP H4-14682U. The double-glazed window glass structure disclosed in this publication includes a pair of glass sheets opposed to each other via a spacer frame body disposed between the glass sheets, a structural sealant for sealing an outer circumference of the spacer frame body, and a mounting bracket including a sash having a projection inserted into the structural sealant. The spacer frame body may be a hollow member made of aluminum and filled with a drying agent, such as granular silica gel.

The double glazed window glass structure described in JP H4-14682U requires the spacer frame body in addition to the sash, and this increases the number of component parts and makes the structure complicated. The drying agent is contained in the hollow interior of the spacer frame body and thus, a container dedicated for containing the drying agent is not necessary. However, it is difficult to design a spacer frame body serving as a container having a hollow interior that can be easily filled with the drying agent while preventing the drying agent from spilling out of the hollow interior which is in communication with a heat insulation space defined between the pair of glass sheets. Further, in actual implementation, it is necessary to configure the spacer frame body to function properly as a container to be filled with the drying agent while ensuring that the spacer frame body accomplishes a function as a spacer for setting a distance between the pair of glass sheets. Thus, the spacer frame body tends to be complicated in structure and/or difficult to manufacture.

SUMMARY OF THE INVENTION

In view of the aforementioned problems in the prior art, a primary object of the present invention is to provide a double glazed window glass structure including a containment structure for containing a drying agent therein such that the containment structure is formed without need for an additional component part, thereby simplifying a structure and reducing the number of component parts.

According to an embodiment of the present invention, there is provided a double glazed window glass structure, including: a frame having a first side and a second side opposite to the first side and defining an outer perimeter of the double glazed window glass structure; a first sheet glass mounted on the first side of the frame; and a second sheet glass mounted on the second side of the frame, the first and second sheet glasses defining a heat insulation space therebetween, wherein the frame includes: an outer frame portion having an inner surface facing both an end surface of the first sheet glass and an end surface of the second sheet glass; and an inner frame portion extending from the inner surface of the outer frame portion toward an inside of the frame, the inner frame portion having a first sheet glass receiving surface facing the first sheet glass and bonded to a first surface of the first sheet glass and a second sheet glass receiving surface facing the second sheet glass and bonded to a first surface of the second sheet glass, wherein the inner frame portion is provided with a groove having an opening that opens in the second sheet glass receiving surface, the groove containing a drying agent therein, and a communication passage allowing only a fluid to flow between the groove and the heat insulation space, and wherein the opening of the groove is closed by the second sheet glass bonded to the second sheet glass receiving surface.

According to this structure, the frame functions both as a spacer member determining a distance between the first sheet glass and the second sheet glass to define a heat insulation space and as a support member for supporting the sheet glasses. Further, the frame itself is provided with a groove for containing a drying agent therein, and the opening of the groove is closed by the second sheet glass bonded to the second sheet glass receiving surface of the frame (more specifically, of the inner frame portion), and thus, no additional component part for containing the drying agent is necessary. This reduces the number of component parts.

Preferably, the first and second sheet glasses have outer peripheral portions bonded to the first and second sheet glass receiving surfaces, respectively, by an adhesive, the outer frame has an exterior surface facing in the same direction in which a second surface of the second sheet glass faces, the second surface being opposite to the first surface of the second sheet glass, and the double glazed window glass structure further includes a reinforcement plate that extends across and is bonded by an adhesive to both the exterior surface of the outer frame portion and the second surface of the second sheet glass.

According to this structure, the reinforcement plate increases the attachment strength of the second sheet glass to the frame, such that a sufficient attachment strength of the second sheet glass to the frame is obtained even though the provision of the groove for containing a drying agent therein decreases the area of the second sheet glass receiving surface of the inner frame portion bonded to the second sheet glass.

Further preferably, the reinforcement plate is opaque.

According to this structure, the reinforcement plate serves also as a blind concealing the groove for containing a drying agent therein, and thus, it is possible to improve the appearance without increasing the number of component parts.

Preferably, a part of the inner frame portion on a side adjacent to the heat insulation space has a concealment wall integrally formed therewith, the concealment wall extending toward the second sheet glass such that an end of the concealment wall is opposed to the first surface of the second sheet glass with a gap defined therebetween while the concealment wall hides the communication passage from view.

According to this structure, the concealment wall integrally formed at the side of the inner frame portion adjacent to the heat insulation space conceals the communication passage formed in the inner frame portion, and thus, it is possible to improve the appearance without increasing the number of component parts.

BRIEF DESCRIPTION OF THE DRAWINGS

Now the present invention is described in the following in terms of preferred embodiments thereof with reference to the appended drawings, in which.

DETAILED DESCRIPTION OF THE PREFERRED EMBODIMENTS

With reference to the appended drawings, description will be made of an embodiment of a double glazed window glass structure according to the present invention.

Figure 1:
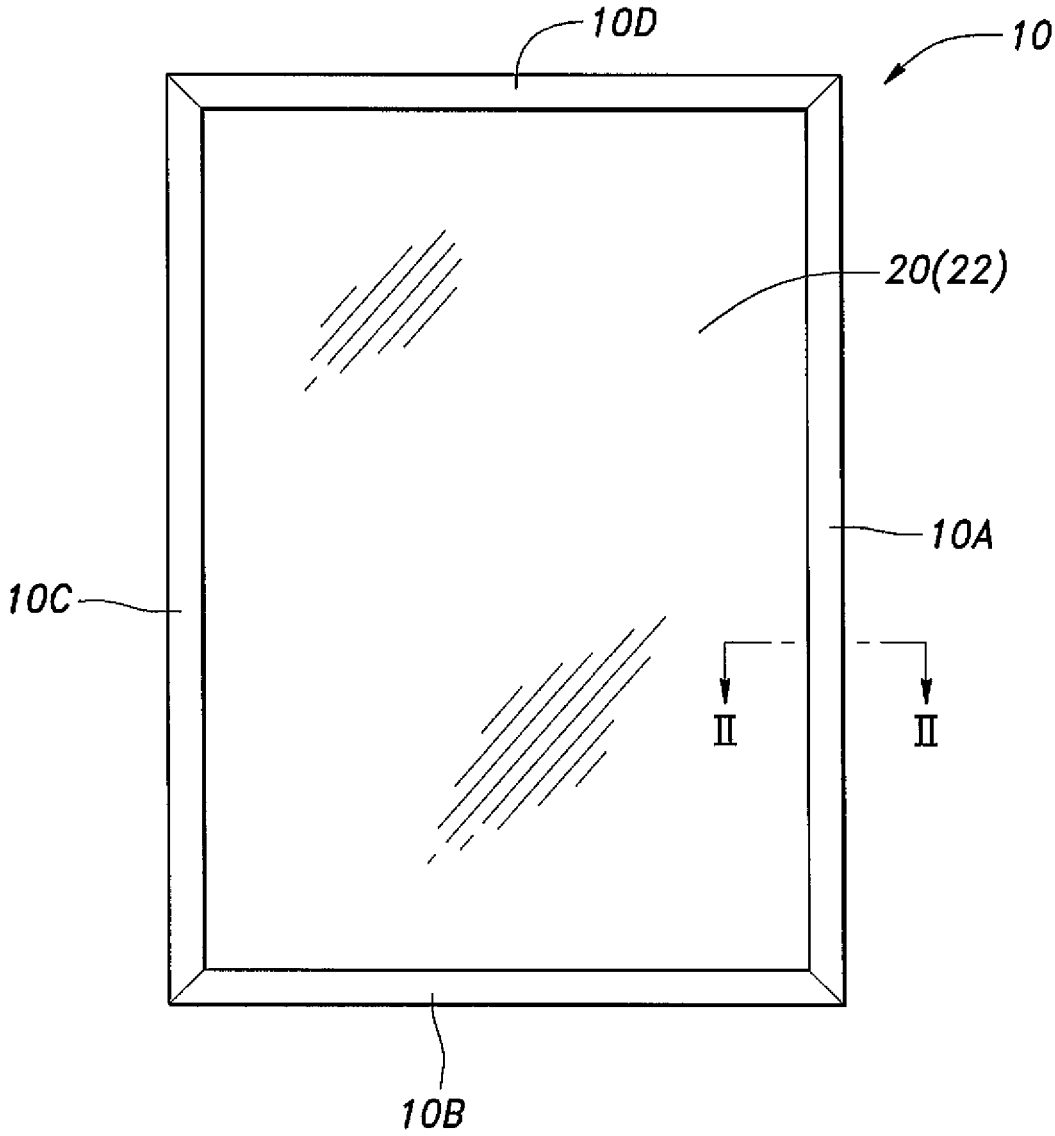
FIG. 1 is a front view showing an embodiment of a double glazed window glass structure according to the present invention.

As shown in FIG. 1, the double glazed window glass structure of this embodiment includes a rectangular frame 10 serving as a window frame (sash). The frame 10 is formed as an assembly of four (right, bottom, left and top) side members 10A, 10B, 10C and 10D, each of which is linear in shape and is made of a rigid synthetic resin, a light metal or the like.

Figure 2:
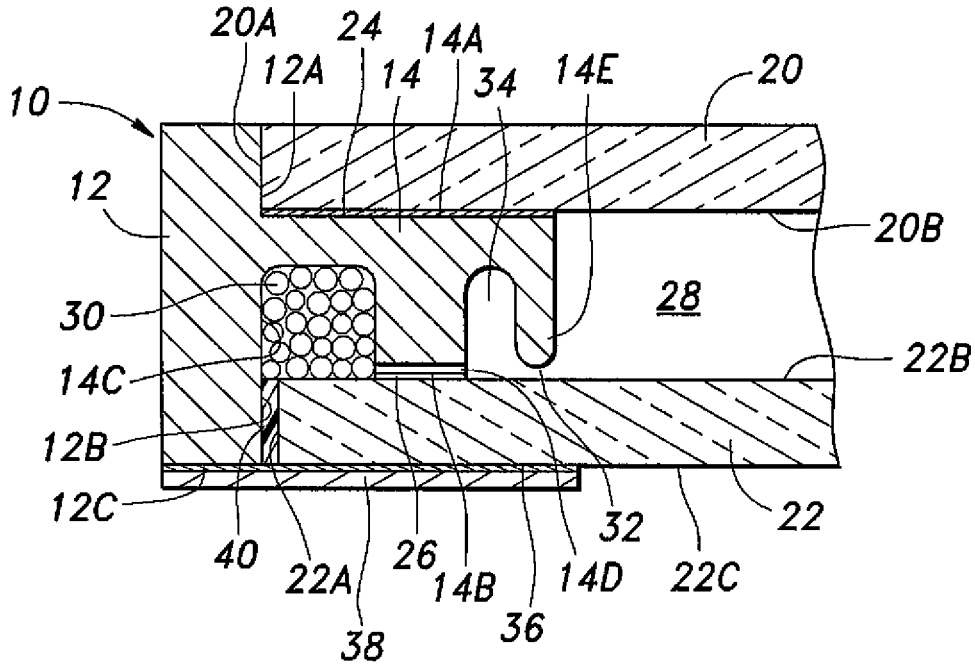
FIG. 2 is an enlarged cross-sectional view taken along line II-II in FIG. 1.
Figure 3:
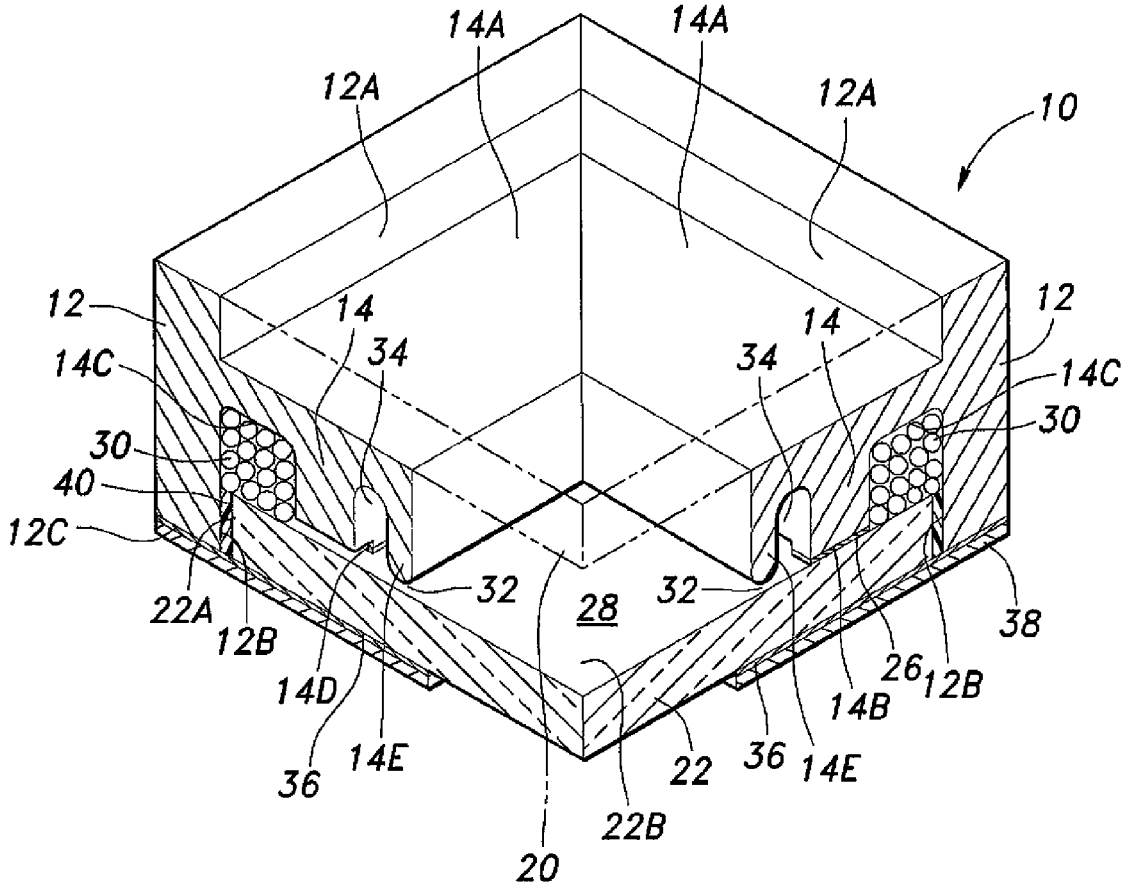
FIG. 3 is a fragmentary perspective view showing a corner portion of the double glazed window glass structure according to the embodiment as viewed from a side of a first sheet glass.
Figure 4:
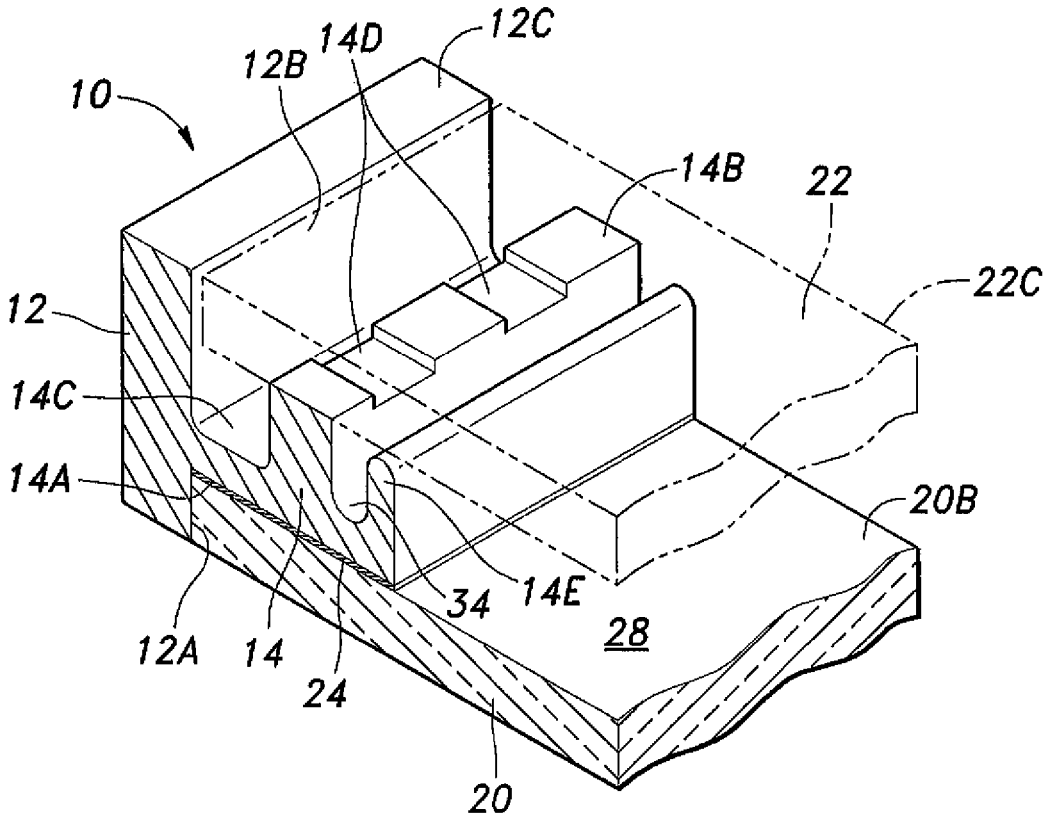
FIG. 4 is a fragmentary perspective view showing the double glazed window glass according to the embodiment as viewed from a side of a second sheet glass, with a reinforcement plate being omitted.

As shown in FIGS. 2-4, the frame 10 includes an outer frame portion 12 and an inner frame portion 14 extending out from an intermediate part of an inner surface of the outer frame portion 12, such that the inner and outer frame portions 12 and 14 are integral with each other. A first sheet glass 20 is mounted on a first side of the inner frame portion 14, while a second sheet glass 22 is mounted on a second side of the inner frame portion 14, the first and second sides of the inner frame portion 14 being opposite to each other. In this embodiment, it is assumed that the first sheet glass 20 is disposed on the interior of a building and the second sheet glass 22 is disposed on the exterior, though it may be otherwise.

The outer frame portion 12 forms an outer wall of the frame 10, and includes an abutting wall surface (shoulder portion) 12A configured to face an end surface 20A of the first sheet glass 20 mounted on the first side of the inner frame portion 14 and an abutting wall surface 12B configured to face an end surface 22A of the second sheet glass 22 mounted on the second side of the inner frame portion 14.

The inner frame portion 14 includes a first sheet glass receiving surface 14A on the first side thereof, the first sheet glass receiving surface 14A bonded to a first surface (an under surface in FIG. 1) 20B of the first sheet glass 20 facing the second sheet glass 22. The inner frame portion 14 further includes a second sheet glass receiving surface 1413 on the second side thereof, the second sheet glass receiving surface 14B bonded to a first surface (un upper surface in FIG. 1) 22B of the second sheet glass 22 facing the first sheet glass 20. The first and second sheet glass receiving surfaces 14A and 14B are in parallel with each other. An outer peripheral portion of the first surface 20B of the first sheet glass 20 is air-tightly bonded to the first sheet glass receiving surface 14A by means of an adhesive layer 24, while an outer peripheral portion of the first surface 22B of the second sheet glass 22 is air-tightly bonded to the second sheet glass receiving surface 14B by means of an adhesive layer 26.

In such a structure, the frame 10 defines an outer perimeter of the double glazed window glass structure, and a tightly sealed heat insulation space 28 is formed between the first and second sheet glasses 20 and 22 with the inner frame portion 14 serving as a spacer member determining the distance between the sheet glasses 20 and 22. Preferably, the peripheral portion of the first sheet glass 20 is given a light shielding property by a light shielding layer formed thereon to protect the adhesive layer 24 from ultraviolet light. The light shielding layer may contain black ceramic pigment, for example.

The inner frame portion 14 is provided with a groove 14C for containing a drying agent therein such that the groove 14C extends over an entire length of the inner frame portion 14 in the longitudinal direction thereof and opens out in the second sheet glass receiving surface 14B. The groove 14C is filled with a granular drying agent 30 such as silica gel.

The inner frame portion 14 is further provided with depressions 14D formed in the second sheet glass receiving surface 14B such that the depressions 14D are arranged in the longitudinal direction of the inner frame portion 14 and spaced apart from each other at a predetermined interval. The depth of each depression 14D is determined to be smaller than the minimum particle size of the drying agent 30. Therefore, the depressions 14D in cooperation with the second sheet glass 22 form a communication passage that allows only a fluid to flow between the groove 14C and the heat insulation space 28 and prevents the drying agent 30 from passing therethrough.

An inner end (or an end adjacent to the heat insulation space 28) of the inner frame portion 14 has a concealment wall 14E integrally formed therewith. The concealment wall 14E extends in a direction vertical to the first surface 22B of the second sheet glass 22 and have an end opposed to the first surface 22B such that a small gap 32 is defined between the end of the concealment wall 14E and the first surface 22B. The concealment wall 14E is spaced apart from the opening of the depressions 14D facing the heat insulation space 28 by a space 34 in the direction toward the heat insulation space 28, and conceals the depressions 14D, which look like comb teeth as viewed from the heat insulation space 28, thereby to improve the appearance. This concealment wall 14E may be optional to the double glazed window glass structure.

The second sheet glass 22 has a second surface 22C opposite to the first surface 22B bonded to the inner frame portion 14, and the outer frame portion 12 has an exterior surface 12C facing in the same direction in which the second surface 22C of the second sheet glass 22 faces. A reinforcement plate 38 is provided so as to extend across both the exterior surface 12C of the outer frame portion 12 and the second surface 22C of the second sheet glass 22 and is bonded by means of an adhesive layer 36 to both the exterior surface 12C of the outer frame portion 12 and the second surface 22C of the second sheet glass 22.

The reinforcement plate 38 increases the attachment strength of the second sheet glass 22 to the frame 10, whereby ensuring a sufficient attachment strength of the second sheet glass 22 to the frame 10 even though the provision of the groove 14C for containing a drying agent therein decreases the area of the second sheet glass receiving surface 14B of the inner frame portion 14 as compared to the first sheet glass receiving surface 14A of the same. The reinforcement plate 38 may be made of a metallic plate or a synthetic resin plate that is opaque and has a light shielding property, thereby also serving as a blind to conceal the groove 14C for containing a drying agent therein, which otherwise would be viewable through the second sheet glass 22. In such a structure, there is no need to form a light shielding layer such as the one containing black ceramic pigment on the peripheral portion of the second sheet glass 22, and thus, it is possible to improve the appearance without increasing the number of component parts or otherwise complicating the structure.

In the illustrated embodiment, the abutting wall surface 12B of the outer frame portion 12 and the end surface 22A of the second sheet glass 22 define a gap therebetween and this gap is filled with a caulking material 40. This favorably ensures an air-tight isolation of the groove 14C containing the drying agent therein and the heat insulation space 28 from the exterior environment.

The adhesive layer 26 and the caulking material 40 are protected from ultraviolet light by the reinforcement plate 38 having a light-shielding property, and thus, do not tend to change with time for an extended period of use and are highly durable In the double glazed window glass structure described in the foregoing, the frame 10 functions both as a spacer member determining a distance between the first sheet glass 20 and the second sheet glass 22 to define a heat insulation space 28 therebetween and as a support member for supporting the sheet glasses 20 and 22. Further, the frame 10 itself is provided with a groove 14C for containing a drying agent 30 therein, and the opening of the groove 14C is closed by the second sheet glass 22 bonded to the second sheet glass receiving surface 14B, and thus, no additional component part for containing the drying agent 30 is necessary. This reduces the number of component parts.

Filling of the groove 14C with the drying agent 30 can be performed prior to closure of the opening of the groove 14C by the second sheet glass 22. This allows the groove 14C to be filled with the drying agent 30 easily through the opening of the groove 14C which may have a relatively large size without being restricted by the particle size (diameter) of the drying agent 30.

Although the present invention has been described in terms of preferred embodiments thereof, it is obvious to a person skilled in the art that various alterations and modifications are possible without departing from the scope of the present invention which is set forth in the appended claims. For example, the double glazed window glass structure of the present invention is not limited to a rectangular shape, and may have a polygonal (such as triangular or hexagonal), circular, elliptical or any other suitable shape. The communication passage between the groove 14C for containing a drying agent therein and the heat isolation space 28 may be formed of one or more through holes formed in the inner frame portion 14 instead of the depressions 14D.

It is also to be noted that not all of the component parts shown in the illustrated embodiments are necessarily indispensable, and they may be selectively used as appropriate without departing from the spirit of the present invention. For example, the reinforcement plate 38 or the caulking material 40 may be omitted.

The contents of the original Japanese patent application (Japanese Patent Application No. 2012-200148 filed on Sep. 12, 2012) on which the Paris Convention priority claim is made for the present application as well as the contents of the prior art references mentioned in this application are incorporated in this application by reference.

The invention claimed is:

1. A double glazed window glass structure, comprising:

a frame having a first side and a second side opposite to the first side and defining an outer perimeter of the double glazed window glass structure;

a first sheet glass mounted on the first side of the frame; and a second sheet glass mounted on the second side of the frame, the first and second sheet glasses defining a heat insulation space therebetween, wherein the frame includes:

an outer frame portion having an inner surface facing both an end surface of the first sheet glass and an end surface of the second sheet glass; and an inner frame portion extending from the inner surface of the outer frame portion toward an inside of the frame, the inner frame portion having a first sheet glass receiving surface facing the first sheet glass and bonded to a first surface of the first sheet glass and a second sheet glass receiving surface facing the second sheet glass and bonded to a first surface of the second sheet glass, wherein the inner frame portion is provided with a groove having an opening that opens in the second sheet glass receiving surface, the groove containing a drying agent therein, and a communication passage allowing only a fluid to flow between the groove and the heat insulation space, and wherein the opening of the groove is closed by the second sheet glass bonded to the second sheet glass receiving surface.

2. The double glazed window glass structure according to claim 1, wherein the first and second sheet glasses have outer peripheral portions bonded to the first and second sheet glass receiving surfaces, respectively, by an adhesive, wherein the outer frame has an exterior surface facing in the same direction in which a second surface of the second sheet glass faces, the second surface being opposite to the first surface of the second sheet glass, and wherein the double glazed window glass structure further comprises a reinforcement plate that extends across and is bonded by an adhesive to both the exterior surface of the outer frame portion and the second surface of the second sheet glass.

3. The double glazed window glass structure according to claim 2, wherein the reinforcement plate is opaque.

4. The double glazed window glass structure according to claim 1, wherein a part of the inner frame portion on a side adjacent to the heat insulation space has a concealment wall integrally formed therewith, the concealment wall extending toward the second sheet glass such that an end of the concealment wall is opposed to the first surface of the second sheet glass with a gap defined therebetween while the concealment wall hides the communication passage from view.

5. The double glazed window glass structure according to claim 2, wherein a part of the inner frame portion on a side adjacent to the heat insulation space has a concealment wall integrally formed therewith, the concealment wall extending toward the second sheet glass such that an end of the concealment wall is opposed to the first surface of the second sheet glass with a gap defined therebetween while the concealment wall hides the communication passage from view.

6. The double glazed window glass structure according to claim 3, wherein a part of the inner frame portion on a side adjacent to the heat insulation space has a concealment wall integrally formed therewith, the concealment wall extending toward the second sheet glass such that an end of the concealment wall is opposed to the first surface of the second sheet glass with a gap defined therebetween while the concealment wall hides the communication passage from view.

* * * * *